US006612363B1

(12) United States Patent
Lorento

(10) Patent No.: US 6,612,363 B1
(45) Date of Patent: Sep. 2, 2003

(54) BEAM BLANK MOLD FOR CONTINUOUS CASTING

(75) Inventor: Donald P. Lorento, London (CA)

(73) Assignee: SMS Demag Inc., Pittsburgh, PA (US)

( * ) Notice: Subject to any disclaimer, the term of this patent is extended or adjusted under 35 U.S.C. 154(b) by 0 days.

(21) Appl. No.: 10/167,286

(22) Filed: Jun. 10, 2002

(51) Int. Cl.[7] ..... B22D 11/04

(52) U.S. Cl. ..... 164/459; 164/418

(58) Field of Search ..... 164/418, 459

(56) References Cited

U.S. PATENT DOCUMENTS 5,615,731 A * 4/1997 Roehrig et al. ..... 164/418

* cited by examiner

*Primary Examiner*—Kuang Y. Lin
(74) *Attorney, Agent, or Firm*—Antonio R. Durando; Durando Birdwell & Janke, PLC

(57) ABSTRACT

A mold for the continuous casting of beam blanks is provided with a casting passage which, as seen in a transverse plane of the mold, has two lateral portions for forming the flanges of a beam blank and a central portion for forming the web of the beam blank. The thickness of the mold wall is reduced in the central portion of the casting passage in order to improve heat transfer.

28 Claims, 3 Drawing Sheets

BEAM BLANK MOLD FOR CONTINUOUS CASTING

BACKGROUND OF THE INVENTION

1. Field of the Invention

The invention relates to continuous casting.

2. Description of the Prior Art

The continuous casting process has been used to produce structural shapes having cross sections of non-uniform thickness. An example of such a structural shape is the beam blank which, as seen in a transverse plane, consists of two flanges connected to one another by a web or crosspiece having a smaller thickness than the flanges.

The mold used to continuously cast a structural shape of non-uniform thickness is provided with a casting cavity having a cross-sectional configuration which corresponds to that of the structural shape. The mold is typically elongated with one end serving as an inlet for molten material and the other end serving as an outlet for the structural shape formed from the material.

In use, the mold is placed in a generally vertical orientation with the inlet end facing up and the outlet end facing down. Cooling water is circulated around the external surface of the mold, and a stream of molten material is introduced into the inlet end of the mold. A pool of the molten material forms in the mold and, at the upper surface of the pool which is referred to as the meniscus, the molten material is in direct and intimate contact with the mold. Slightly below the meniscus, solidification begins to occur adjacent to the internal surface of the mold. A skin of solidified material develops around the molten pool and forms a shield between the pool and the mold so that there is no longer direct contact between the molten material and the mold. Furthermore, due to the shrinkage which accompanies solidification, the skin tends to pull away from the mold so that the contact between the skin and the mold is less intimate than that between the molten material and the mold.

The thickness of the skin increases with increasing distance from the meniscus and, since solidification proceeds in a direction from the internal surface of the mold towards the center of the mold, the cross-sectional area of the pool decreases as the skin thickness increases. The molten pool normally does not solidify completely inside the mold and the product withdrawn from the outlet end of the mold thus consists of a molten core within a shell of solidified material. The cast product is sprayed with water after exiting the mold to complete solidification.

During casting, heat flows from the interior to the exterior of the mold via the internal mold surface which can thus be considered to constitute a heat source. On the other hand, the cooled external surface of the mold, where the heat is carried away from the mold, can be considered to constitute a heat sink.

The mold wall has a constant thickness which is sufficiently large to allow the wall to withstand the pressure of the molten pool inside the mold. In the portions of the mold wall which adjoin the area where the thickness of the casting cavity changes as seen in a transverse plane of the mold, the length of the internal mold surface as measured in the transverse plane is greater than the length of the external mold surface as measured in this plane. Thus, in these portions of the mold wall, the heat source has a substantially greater length than the heat sink which is the reverse of the situation in the remaining portions of the mold wall. Consequently, the rate of heat extraction from the mold in the portions of the mold wall where the thickness of the casting cavity changes is less than the rate in the remaining portions of the mold wall.

At the meniscus level, where the molten material is in intimate contact with the internal surface of the mold wall, the reduced rate of heat extraction causes the temperature of the internal mold surface to increase. This temperature increase can lead to erosion of the mold wall. Below the meniscus level, on the other hand, where a skin has developed and is in less intimate contact with the internal mold surface than is the molten material, the reduced rate of heat extraction from the mold causes the skin thickness to increase more slowly. As a result, cracks are formed in the cast product.

SUMMARY OF THE INVENTION

It is an object of the invention to improve the rate of heat extraction in an area where a mold undergoes a dimensional change.

The preceding object, as well as others which will become apparent as the description proceeds, are achieved by the invention.

One aspect of the invention resides in a mold for the continuous casting of molten material. The mold comprises an elongated hollow member defining a casting passage which extends longitudinally of the hollow member. The casting passage has an inlet end for the molten material and an outlet end for a continuously cast product formed from the molten material. The casting passage includes a first portion and a second portion, and the second portion of the casting passage varies in at least one dimension and has at least one location where such dimension is smaller than at any location of the first portion. The hollow member comprises a wall which includes a first section partially bounding the first portion of the casting passage and a second section partially bounding the second or varying portion of the casting passage. The second section of the wall has at least one segment with a wall thickness which is less than that at any location of the first section of the wall.

In a mold according to the invention, a casting passage includes a portion having a variable dimension and this varying portion is partially bounded by a section of a wall. Such section includes at least one segment with a thickness which is reduced relative to the thickness of another section of the wall. The reduction in wall thickness has the effect of decreasing the difference in length between the internal surface of the wall segment and the external surface of the wall segment. As noted earlier, the internal surface of a mold wall may be considered to constitute a heat source whereas the external surface may be considered to constitute a heat sink. Accordingly, in a varying portion of a mold according to the invention, the difference in length between the heat source and the heat sink is smaller than that in conventional molds thereby allowing improved heat transfer to be obtained. Inasmuch as only a minor part of the mold wall needs to have a reduced thickness, this result may be achieved with little or no sacrifice in the strength of the mold wall.

Another aspect of the invention resides in a method of making a mold for the continuous casting of molten material. The method comprises the step of forming an elongated hollow member which defines at least part of a casting passage. The casting passage extends in the longitudinal direction of the hollow member and has an inlet end for the molten material and an outlet end for a continuously cast product formed from the molten material. The casting passage includes a first portion and a second portion, and the second portion of the casting passage varies in at least one selected dimension and has a selected location where the selected dimension is smaller than at any location of the first portion of the casting passage. The hollow member includes a wall having a first section which partially bounds the first portion of the casting passage and a second section which partially bounds the second, varying portion of the casting passage. The method further comprises the step of reducing the wall thickness of a selected segment of the second section of the wall to a value less than that at any location of the first section of the wall.

Since the first portion of the casting passage can have fixed dimensions, the first portion of the casting passage may hereinafter be referred to as the fixed portion of the casting passage for convenience. Similarly, inasmuch as the first wall section partially bounding the fixed portion of the casting passage is thicker than the reduced-thickness segment of the second wall section partially bounding the varying portion of the casting passage, the first wall section will hereinafter be referred to as the thicker wall section. On the other hand, the second wall section will be referred to as the thinner wall section.

The step of forming the elongated hollow member may involve shaping the wall of the hollow member so that the varying portion of the casting passage has at least one part at which the variable dimension this portion is a minimum. The step of reducing the thickness of a selected segment of the thinner wall section is then advantageously performed in such a manner that the selected segment adjoins the part of the casting passage at which the variable dimension is a minimum.

The thinner wall section can have another segment which extends from the selected segment of reduced thickness along the part of the casting passage at which the variable dimension is a minimum. The step of reducing the thickness of a selected segment of the thinner wall section may here comprise shaping the other segment of the thinner wall section such that the other segment widens in a direction away from the selected segment of the thinner wall section.

The wall of the hollow member may include an additional section which partially bounds the varying portion of the casting passage such that the varying portion is sandwiched between the additional section and the thinner section of the wall. The method can then comprise the step of reducing the wall thickness of a segment of the additional wall section to a value less than that at any location of the thicker wall section.

The casting passage can have an additional portion, and the additional portion of the casting passage may be situated so that the varying portion of the casting passage is located between the fixed portion and the additional portion. As indicated previously, the varying portion of the casting passage has a selected location at which a selected dimension is smaller than at any location of the fixed portion of the casting passage, and the selected dimension of this selected location is also smaller than at any location of the additional portion of the casting passage. The wall of the hollow member includes another section which partially bounds the additional portion of the casting passage, and the step of reducing the thickness of a selected segment of the thinner wall section may here include decreasing the wall thickness of the selected segment to a value less than that at any location of the other wall section.

Since, like the first portion of the casting passage, the additional portion of the casting passage can have fixed dimensions, the additional portion of the casting passage will hereinafter be referred to as an additional fixed portion for convenience.

The step of forming the hollow member can involve shaping the wall of the hollow member so that at least one part of the varying portion of the casting passage narrows in a direction away from the fixed portion of the casting passage. The shaping may be performed in such a manner that this part of the casting passage narrows substantially continuously in a direction away from the fixed portion of the casting passage.

The step of forming the hollow member can further comprise shaping the wall of the hollow member so that an additional part of the varying portion of the casting passage narrows in a direction towards the fixed portion of the casting passage.

The step of forming the hollow member may also comprise shaping the wall of the hollow member so that the part of the casting passage at which the variable dimension is a minimum is substantially centered with respect to the fixed portion and the additional fixed portion of the casting passage. The wall of the hollow member can be shaped in such a manner that the casting passage resembles a beam having a pair of flanges joined by a web.

The thinner wall section may include at least one additional segment which is located between the thicker wall section and the selected segment of the thinner wall section. The method can here additionally comprise the step of shaping the additional segment of the thinner wall section so that the additional segment narrows in a direction away from the thicker wall section. The shaping of the additional segment may be performed in such a manner that the additional segment narrows substantially continuously in a direction away from the thicker wall section.

The additional segment of the thinner wall section can be disposed to one side of the part of the casting passage at which the variable dimension is a minimum and the thinner wall section may have a second additional segment on an opposite side of this part of the casting passage. The step of reducing the thickness of a selected segment of the thinner wall section can then comprise shaping the second additional segment so that the latter narrows in a direction towards the thicker wall section.

The step of forming the hollow member may involve shaping the thinner wall section so that this wall section defines at least one concavity as seen from externally of the hollow member.

The thicker wall section has at least one location with a predetermined wall thickness which is less than or equal to the wall thickness at all other locations of the thicker wall section. Also, the selected segment of the thinner wall section includes a first surface portion which faces the casting passage and a second surface portion which faces away from the casting passage. The steps of forming the hollow member and reducing the thickness of the selected segment of the thinner wall section can here comprise: (a) shaping the first surface portion to produce an arc which has a first radius and is concave as seen from externally of the hollow member; and (b) shaping the second surface portion to produce an arc which has a second radius smaller than the first radius and is concave as seen from externally of the hollow member. The steps of forming the hollow member and reducing the thickness of the selected segment of the thinner wall section are carried out in such a way that the second radius differs from the first radius by less than the predetermined wall thickness of the thicker wall section.

The step of forming the hollow member may be performed such that the thicker wall section has a substantially constant wall thickness.

Additional features and advantages of the invention will be forthcoming from the following detailed description of certain specific embodiments when read in conjunction with the accompanying drawings.

DESCRIPTION OF THE PREFERRED EMBODIMENTS

Figure 1:
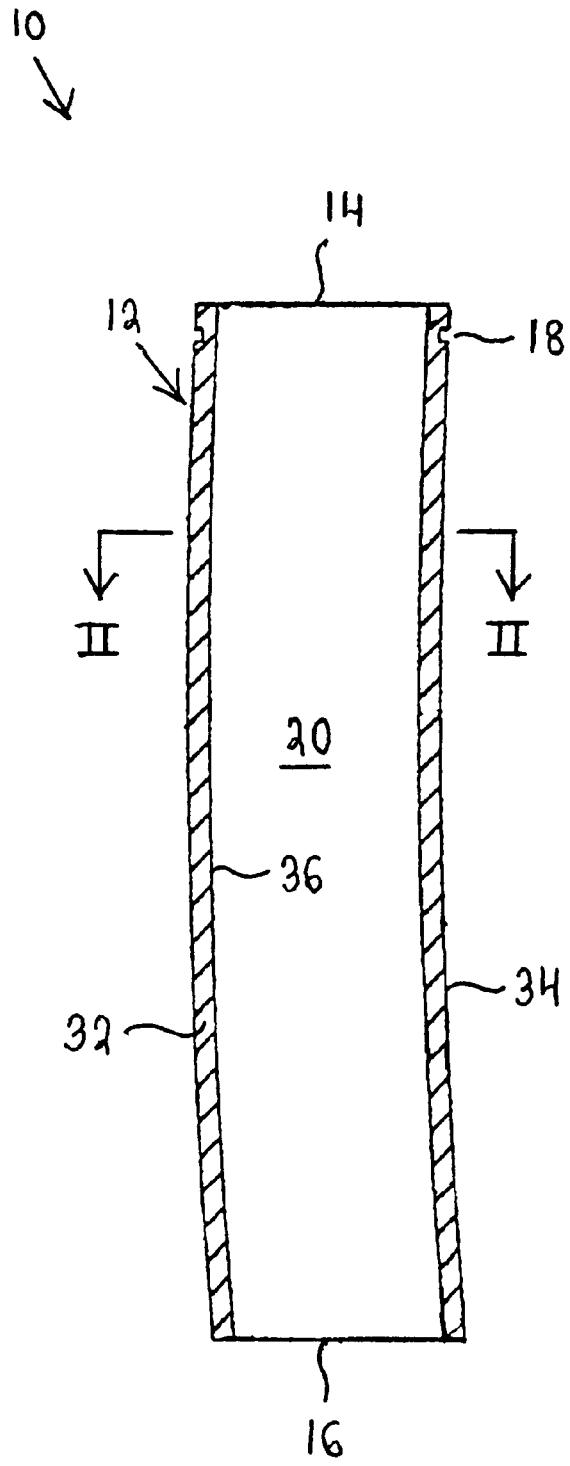
FIG. 1 is a longitudinal sectional side view of a continuous casting mold in accordance with the invention.
Figure 2:
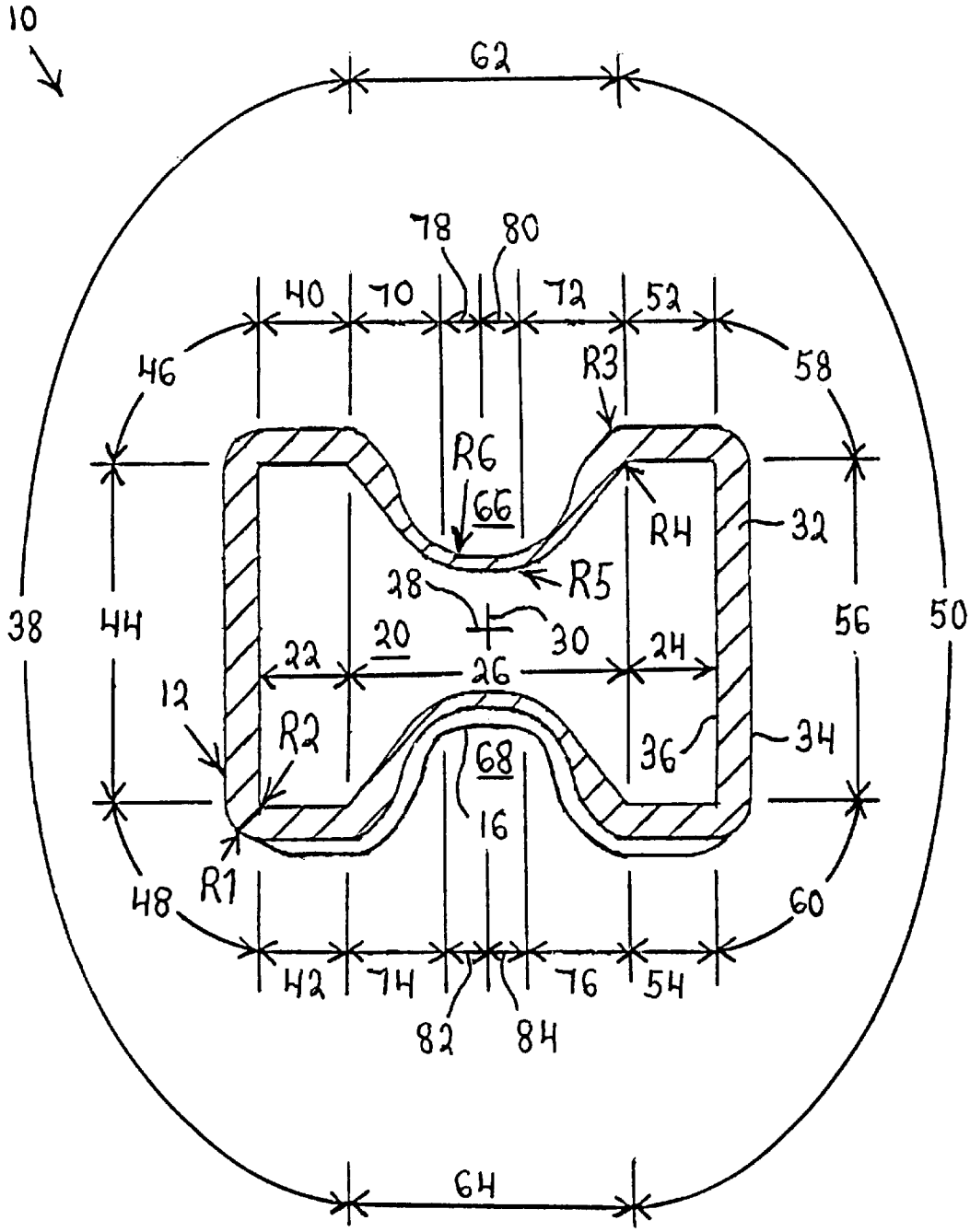
FIG. 2 is a transverse sectional view of the mold of FIG. 1 as seen in the direction of the arrows II—II of FIG. 1.

Referring to FIGS. 1 and 2, the numeral 10 identifies a mold according to the invention for the continuous casting of molten material, e.g., molten steel. The mold 10 is a beam blank mold, that is, a mold of the type which produces a cast product having an outline resembling that of a beam. The mold 10, which is typically made of copper or a copper alloy, includes an elongated hollow member 12 as well as non-illustrated flanges serving to suspend the mold 10 in a non-illustrated continuous casting apparatus. The hollow member 12 is here in the form of a tube having a longitudinal end 14 and an opposite longitudinal end 16. A notch 18 runs circumferentially of the tube 12 at the longitudinal end 14 and allows the tube 12 to be held securely.

As shown in FIG. 1, the mold 10 is of the curved type. Thus, the tube 12 arcs from the longitudinal end 14 of the tube 12 to the longitudinal end 16.

The tube 12 defines a casting passage 20 which runs longitudinally of the tube 12 from the longitudinal end 14 to the longitudinal end 16. In use, the tube 12 has a generally vertical orientation as in FIG. 1 with the longitudinal end 14 facing up and the longitudinal end 16 facing down. The longitudinal ends 14 and 16 are open, and the longitudinal end 14 constitutes an inlet end for the admission of molten material into the casting passage 20 while the longitudinal end 16 constitutes an outlet end for the withdrawal of a continuously cast product formed from the molten material. The tube 12 will typically have a small taper from the longitudinal end 14 to the longitudinal end 16, and this taper is such that the tube 12 narrows continuously from the longitudinal end 14 to the longitudinal end 16. The taper is of advantage because the material admitted into the casting passage 20 cools and shrinks as it travels through the passage 20 and the taper takes the shrinkage into account.

FIG. 2 represents a transverse plane of the tube 12. In the description of FIG. 2, the terms "horizontal", "vertical", "straight" and "linear" will be with reference to the showing in FIG. 2 and may not necessarily represent the situation in three dimensions. Furthermore, the terms "convex" and "concave" will be taken to mean that an element is convex or concave as seen from externally of the tube 12.

The casting passage 20 includes a lateral portion 22 having fixed dimensions as measured in the transverse plane of FIG. 2 and a lateral portion 24 also having fixed dimensions as measured in this plane. The casting passage 20 further includes a central portion 26 which is located between the lateral portion 22 and the lateral portion 24 and has a variable dimension as measured in the transverse plane. The lateral portion 22 and the central portion 26 share a common boundary as do the lateral portion 24 and the central portion 26.

A straight horizontal center line 28 bisects the tube 12 vertically in FIG. 2 whereas a straight vertical center line 30 bisects the tube 12 horizontally. The lines 28 and 30 meet at the center of the tube 12 and the casting passage 20, and the tube 12 and the casting passage 20 are mirror-symmetrical about the center line 28 and about the center line 30. The center line 28 passes through the lateral portion 22, the lateral portion 24 and the central portion 26 of the casting passage 20. For descriptive purposes, dimensions of the casting passage 20 measured perpendicular to the center line 30 will be referred to as widths and dimensions measured perpendicular to the center line 28 will be referred to as thicknesses.

With reference still to FIG. 2, the lateral passage portion 22 has a substantially constant width and a substantially constant thickness and is substantially rectangular. The lateral passage portion 24 likewise has a substantially constant width and a substantially constant thickness and is substantially rectangular. The widths of the lateral passage portions 22,24 are the same as are the thicknesses of the lateral portions 22,24.

Contrary to the lateral passage portions 22,24, the central passage portion 26 has a variable thickness. The thickness of the central passage portion 26 decreases continuously or progressively from the junction with the lateral passage portion 22 to the center line 30 and from the junction with the lateral passage portion 24 to the center line 30. Thus, the central passage portion 26 has one part whose thickness decreases in a direction away from the lateral passage portion 22 and towards the lateral passage portion 24. The central passage portion 26 further has another part whose thickness decreases in a direction away from the lateral passage portion 24 and towards the lateral passage portion 22. The thickness of the central passage portion 26 is a maximum at the junctions with the respective lateral passage portions 22,24, and the thickness of the central portion 26 at each of these junctions is the same. On the other hand, the thickness of the central passage portion 26 is a minimum at the center line 30 located midway between the lateral passage portion 22 and the lateral passage portion 24.

As seen in the transverse plane of FIG. 2, the casting passage 20 resembles a beam blank having two spaced, generally rectangular flanges and a web or crosspiece of variable thickness connecting the flanges to one another. The lateral passage portions 22,24 correspond to the flanges whereas the central passage portion 26 corresponds to the web or crosspiece.

The tube 12 has a peripheral wall 32 which surrounds the casting passage 20 and will also be referred to as the mold wall. The mold wall 32 has an external surface 34 which faces away from the casting passage 20 and is cooled with water when the mold 10 is being used for casting. The mold wall 32 also has an internal surface 36 which faces the casting passage 20 and, during casting, is in contact with the material being cast. Thus, when the mold 10 is in use, the internal mold surface 36 is significantly hotter than the external mold surface 34 and the heat flux is from the interior of the mold 10 to the exterior thereof. Heat leaves the casting passage 20 via the internal mold surface 36 and flows to the external mold surface 34 where the heat is carried away from the mold 10 by the cooling water. Hence, the internal mold surface 36 may be considered to constitute a heat source while the external mold surface 34 may be considered to constitute a heat sink.

The lateral passage portion 22 is partially bounded by a C-shaped lateral section 38 of the mold wall 32. The lateral wall section 38 includes two straight, parallel, horizontal segments 40 and 42 which are spaced from one another, and the lateral wall section 38 further includes a straight vertical segment 44 which extends between the horizontal wall segments 40,42. The vertical wall segment 44 is connected to the horizontal wall segments 40,42 by respective convex segments 46 and 48 of the lateral wall section 38. Each of the convex wall segments 46,48 has an outer radius R1 and a smaller inner radius R2.

The lateral passage portion 24 is partially bounded by a lateral section 50 of the mold wall 32, and the lateral wall section 50 is mirror-symmetrical to the lateral wall section 38 about the center line 30 of the tube 12. Thus, the lateral wall section 50 resembles a backward C. The lateral wall section 50 comprises two straight, parallel, horizontal segments 52 and 54 which are spaced from each other, and the lateral wall section 50 further comprises a straight vertical segment 56 which runs between the horizontal wall segments 52,54. The vertical wall segment 56 is joined to the horizontal wall segments 52,54 by respective convex segments 58 and 60 of the lateral wall section 50. The convex wall segments 58,60 again have an outer radius R1 and an inner radius R2.

The lateral wall sections 38,50 preferably have a constant thickness throughout, and the thickness of the lateral wall section 38 is then advantageously the same as that of the lateral wall section 50. Under such circumstances, the difference between the outer radius R1 and the inner radius R2 of the convex wall segments 46,48,58,60 equals the thickness of the lateral wall sections 38,50.

The central passage portion 26 is partially bounded by two central sections 62 and 64 of the mold wall 32. The central wall section 62 is U-shaped and defines a concavity 66 whereas the central wall section 64, which is mirror-symmetrical to the central wall section 62 about the center line 28 of the tube 12, resembles an inverted U and defines a concavity 68. The central wall section 62 bridges the straight segment 40 of the lateral wall section 38 and the straight segment 52 of the lateral wall section 50 while the central wall section 64 bridges the straight segment 42 of the lateral wall section 38 and the straight segment 54 of the lateral wall section 50.

The central wall section 62 includes a transition segment 70 which extends from the straight segment 40 of the lateral wall section 38 partway to the center line 30 of the tube 12. The end of the transition wall segment 70 which adjoins the straight wall segment 40 is convex and has an outer radius R3 and a smaller inner radius R4. The difference between R3 and R4 is equal to the thickness of the straight wall segment 40 at the junction of the straight segment 40 and the transition wall segment 70. The transition wall segment 70 narrows in a direction away from the straight wall segment 40 and achieves a minimum thickness at the end thereof remote from the straight segment 40. Furthermore, the transition wall segment 70 undergoes an inflection, and the end of the transition segment 70 remote from the straight segment 40 is concave.

The central wall section 62 comprises another transition segment 72 which runs from the straight segment 52 of the lateral wall section 50 partway to the center line 30 of the tube 12. The transition wall segment 72 is a mirror image of the transition wall segment 70 about the center line 30.

Similarly, the central wall section 64 includes a transition segment 74 which extends from the straight segment 42 of the lateral wall section 38 partway to the center line 30 of the tube 12. The central wall section 64 further includes a transition segment 76 which runs from the straight segment 54 of the lateral wall section 50 partway to the center line 30, and the transition segment 76 is mirror-symmetrical to the transition segment 74 about the center line 30. Moreover, the transition segments 74,76 of the central wall section 64 are mirror images of the respective transition segments 70,72 of the central wall section 62 about the center line 28 of the tube 12.

The central wall section 62 additionally comprises a relatively thin or narrow segment 78 which extends from the transition wall segment 70 to the center line 30 of the tube 12, and the thickness at each location of the thin wall segment 78 is less than that at any location of the lateral wall segments 38,50. Preferably, the thin wall segment 78 has a constant thicknes throughout. The thin wall segment 78 is concave and has an outer radius R5 and a smaller inner radius R6.

The central wall section 62 includes another relatively thin or narrow segment 80 which runs from the transition wall segment 72 to the center line 30 of the tube 12, and the thin wall segment 80 is mirror-symmetrical to the thin wall segment 78 about the center line 30.

Likewise, the central wall section 64 comprises a relatively thin or narrow segment 82 which extends from the transition wall segment 74 to the center line 30 of the tube 12. The central wall section 64 further comprises a relatively thin or narrow segment 84 which runs from the transition wall segment 76 to the center line 30, and the thin wall segment 84 is a mirror image of the thin wall segment 82 about the center line 30. Furthermore, the thin wall segments 82,84 of the central wall section 64 are mirror-symmetrical to the respective thin wall segments 78,80 of the central wall section 62 about the center line 28 of the tube 12.

Each of the thin wall segments 78,80,82,84 adjoins the center line 30 of the tube 12 and, hence, the thinnest part of the central passage portion 26.

A conventional beam blank mold with a casting passage substantially identical to the casting passage 20 of the mold 10 differs from the mold 10 primarily in that the mold wall has a uniform thickness throughout. Thus, the central wall sections corresponding to the wall sections 62,64 of the mold 10 have the same thickness as the lateral wall sections corresponding to the wall sections 38,50 of the mold 10. Hence, as seen in a transverse plane such as that of FIG. 2, the length of the internal surface of each central wall section of the conventional mold exceeds the length of the external surface which is the reverse of the situation for the lateral wall sections. This stems from the fact that the central wall sections include concave surfaces whereas the lateral wall sections do not. For each of the central wall sections of the conventional mold, the length of the heat source is accordingly significantly greater than the length of the heat sink contrary to the situation for the lateral wall sections. As a result, the rate of heat extraction from the mold through the central wall sections is substantially less than the rate of heat extraction through the lateral wall sections. This can lead to erosion of the internal surfaces of the central wall sections and can also cause the formation of cracks in the cast product withdrawn from the mold.

According to the invention, the central wall section 62 of the mold 10 includes the thin segments 78,80 of lesser thickness than the lateral wall sections 38,50. Similarly, the central wall section 64 comprises the thin segments 82,84 which are again of lesser thickness than the lateral wall sections 38,50.

The reduction in thickness of the thin segments 78,80 of the central wall section 62 has the effect of decreasing the difference in length, as seen in the transverse plane of FIG. 2, between the external surface and the internal surface of the central wall section 62. Consequently, the length of the heat source is more nearly equal to the length of the heat sink than in a conventional mold and the rate of heat transfer through the central wall section 62 is increased. The same holds true for the central wall section 64 with the thin segments 82,84.

The invention recognizes that one of the factors determining the heat transfer characteristics of a beam blank mold is the configuration of the concave wall segments which adjoin the locations where the central passage portion of the mold achieves its minimum thickness, i.e., the configuration of the wall segments corresponding to the thin segments 78,80,82,84 of the mold 10. As seen in a transverse plane such as that of FIG. 2, the ratio of the length of the internal surface to the length of the external surface of each central wall section corresponding to the wall sections 62,64 of the mold 10 is a function of the ratio of the outer radius to the inner radius of the concave wall segments adjoining the thinnest part of the central passage portion. In other words, the ratio of the length of the heat source to the length of the heat sink is a function of the ratio of the outer radius of such a concave wall segment to the inner radius of the concave wall segment. The outer radius corresponds to the radius R5 of FIG. 2 and the inner radius to the radius R6.

In a beam blank mold, as the ratio of the outer radius to the inner radius of a concave wall segment decreases, the ratio of the length of the heat source to the length of the heat sink decreases thereby increasing the rate of heat extraction from the central portion of the casting passage. The ratio of the outer radius to the inner radius can be decreased by locally reducing the thicknesses of the central wall sections corresponding to the wall sections 62,64 of the mold 10 and, in particular, by reducing the thicknesses of the concave wall segments adjacent to the thinnest part of the central passage portion. Thus, in the mold 10 of the invention, where the central wall sections 62,64 include the segments 78,80,82,84 of reduced thickness, the ratio of R5 to R6 is decreased relative to the same ratio in a conventional beam blank mold having a casting passage substantially identical to the casting passage 20 of the mold 10. As a result, the difference between R5 and R6 in the mold 10 is less than the thickness of the lateral wall sections 38,50 in contrast to the conventional mold where the corresponding difference equals the thickness of the lateral wall sections.

The transition segments 70,72,74,76 of the central wall sections 62,64 of the mold 10 are designed to provide smooth transitions between the relatively thick lateral wall sections 38,50 and the thin wall segments 78,80,82,84.

Figure 3:
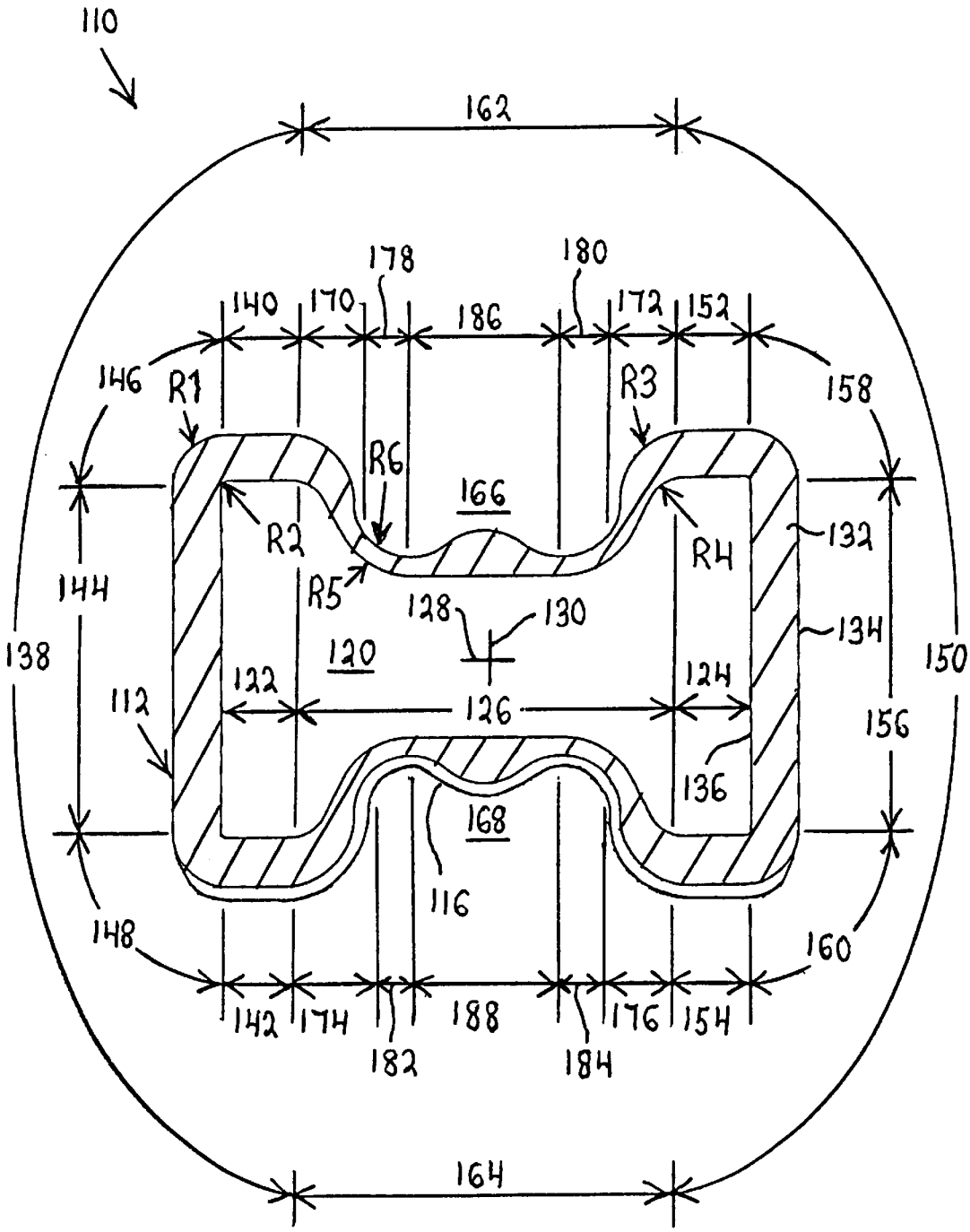
FIG. 3 is similar to FIG. 2 but shows another embodiment of a continuous casting mold according to the invention.

Turning to FIG. 3, the same reference numerals as in FIGS. 1 and 2, plus 100, are used to identify similar elements while corresponding radii in FIGS. 2 and 3 have identical designations. Due to the correspondence between the reference numerals of FIG. 3 and those of FIGS. 1 and 2, it is unnecessary to specifically mention each reference numeral in FIG. 3.

The mold 110 of FIG. 3 differs from the mold 10 of FIGS. 1 and 2 primarily in that the thinnest part of the central passage portion 126 of the mold 110 has a measurable width whereas the thinnest part of the central passage portion 26 of the mold 10 lies on a line, namely, the center line 30. As a result of this distinction, the thin wall segments 178,180 of the mold 110 do not abut unlike the thin wall segments 78,80 of the mold 10. Similarly, the thin wall segments 82,184 of the mold 110 do not meet in contrast to the thin wall segments 82,84 of the mold 10.

The central wall section 162 of the mold 110 includes a segment 186 which partially bounds and extends across the width of the thinnest part of the central passage portion 126. The segment 186 bridges the thin segments 178,180 of the central wall section 162 and is centered with respect to the lateral wall sections 138,150 of the mold 110.

The end of the bridging wall segment 186 which adjoins the thin segment 178 of the central wall section 162 has the same thickness as the thin segment 178 and is concave like the latter. The thickness of the bridging wall segment 186 increases from the thin wall segment 178 in a direction towards the center line 130 of the tube 112, and the bridging segment 186 undergoes an inflection and becomes convex between the thin wall segment 178 and the center line 130.

Similarly, the end of the bridging wall segment 186 which adjoins the thin segment 180 of the central wall section 162 has the same thickness as the thin segment 180 and is concave like the latter. The thickness of the bridging wall segment 186 again increases from the thin wall segment 180 towards the center line 130 of the tube 112, and the bridging segment 186 again undergoes an inflection and becomes convex between the thin wall segment 180 and the center line 130.

The thickness of the bridging wall segment 186 at the center line 130 of the tube 112 is preferably equal to or greater than the thickness at any other location of the bridging segment 186. The maximum thickness of the bridging wall segment 186 can equal or exceed the thickness at any location of the lateral wall sections 138,150 of the mold 110.

The central wall section 164 of the mold 110 comprises a segment 188 which, like the bridging wall segment 186 of the central wall section 162, partially bounds and extends across the width of the thinnest part of the central passage portion 126. The segment 188, which bridges the thin segments 182,184 of the central wall section 164, is a mirror image of the bridging wall segment 186 about the center line 128 of the tube 112.

In FIG. 3, the external surface of the bridging wall segment 186 resembles a bell curve while the external surface of the bridging wall segment 188 resembles an inverted bell curve. The maximum thickness of each bridging wall segment 186,188 occurs at the center line 130 of the tube 112 and all other locations of the bridging wall segments 186,188 have smaller thicknesses. Furthermore, the lateral wall sections 138,150 of the mold 110 have the same constant thickness throughout and the maximum thickness of each bridging wall segment 186,188 equals the thickness of the lateral wall sections 138,150.

As also seen in FIG. 3, the internal surfaces of the bridging wall segments 186,188 define respective straight lines which are parallel to the center line 128 of the mold 110. Hence, the thickness of the thinnest part of the central passage portion 126 is constant across the width of such thinnest part.

As is the case for the thin segments 78,80 of the central wall section 62 of the mold 10, the reduction in thickness of the thin segments 178,180 of the central wall section 162 of the mold 110 has the effect of decreasing the difference in length, as seen in the transverse plane of FIG. 3, between the external surface and the internal surface of the central wall section 162. Consequently, the length of the heat source is more nearly equal to the length of the heat sink than in a conventional mold and the rate of heat transfer through the central wall section 162 is increased. The same applies to the thin wall segments 182,184 and central wall section 164 of the mold 110.

While it is possible to design the bridging wall segments 186,188 of the mold 110 so that the thickness of each bridging segment 186,188 remains equal to the thickness of the thin wall segments 178,180,182,184 across the width of the thinnest part of the central passage portion 126, this could unduly weaken the mold 110. Accordingly, it is preferred for the thickness of the bridging wall segments 186,188 to increase in a direction away from the thin wall segments 178,180,182,184.

In the mold 10,110 of the invention, the rate of heat extraction from the casting passage 20,120 by way of the wall sections 62,64,162,164 partially bounding the central passage portion 26,126 exceeds that in a conventional beam blank mold. This allows the temperatures at the internal surfaces of the wall sections 62,64,162,164 to be reduced. At the meniscus level, the reduction in temperature can lessen erosion of the internal surfaces of the wall sections 62,64, 162,164. Below the meniscus level, the reduction in temperature enables solidification of the cast product to be enhanced so that crack formation in the cast product is inhibited.

Inasmuch as the wall thickness of the mold 10,110 is only reduced locally, there is little, if any, effect on the strength of the mold 10,110.

The mold 10,110 may be produced by extruding a copper or copper alloy body onto a die shaped like a beam blank. The extrusion process yields a tubular member which includes the casting passage 20,120 and a wall of uniform thickness surrounding the passage 20,120. The central wall sections 62,64,162,164 of the tubular member are machined to: (a) shape the transition wall segments 70,72,74,76,170, 172,174,176 so that these narrow in a direction towards the center line 30,130 of the tube 12,112; (b) increase the inner radii R6 and uniformly decrease the thicknesses of the thin wall segments 78,80,82,84,178,180,182,184; and, in the case of the mold 110, (c) shape the bridging wall segments 186,188 so that these widen in a direction in a direction towards the center line 130 of the tube 112.

It is also possible to produce the mold 10,110 by casting copper or a copper alloy around a die having the outline of a beam blank. Similarly to the extrusion process, the casting operation results in a tubular member having a wall of constant thickness which defines the casting passage 20,120. The central wall sections 62,64,162,164 of such tubular member can be machined in the same manner as the central wall sections 62,64,162,164 of the tubular member formed by extrusion.

The mold 10,110 can further be generated by producing a piece of stock tubing and applying explosive charges to the outer surface thereof. The tubing is thereupon placed over a die configurated like a beam blank and the explosive charges are detonated to cause the tubing to assume the shape of the die. This explosive forming process again yields a tubular member having the casting passage 20,120 and a wall of uniform thickness bounding the passage 20,120. The central wall sections 62,64,162,164 of this tubular member may be machined as above.

Various modifications are possible within the meaning and range of equivalence of the appended claims. By way of example, the invention is applicable not only to molds with H-shaped or I-shaped casting passages but also to other molds in which the casting passages include one or more portions of varying cross section, e.g., molds with T-shaped casting passages.

I claim:

1. A mold for the continuous casting of molten material comprising:

an elongated hollow member defining a casting passage which extends longitudinally of said hollow member, said casting passage having an inlet end for the molten material and an outlet end for a continuously cast product formed from the molten material, and said casting passage including a first portion and a second portion, said second portion of said casting passage varying in at least one dimension and having at least one location where said one dimension is smaller than at any location of said first portion of said casting passage, and said hollow member comprising a wall which includes a first section partially bounding said first portion of said casting passage and a second section partially bounding said second portion of said casting passage, said second section of said wall having at least one segment with a wall thickness which is less than that at any location of said first section of said wall.

2. The mold of claim 1, wherein said second portion of said casting passage has at least one part at which said one dimension is a minimum, said one segment of said wall adjoining said one part.

3. The mold of claim 2, wherein said second section of said wall has another segment which extends from said one segment of said wall along said one part of said casting passage, said other segment widening in a direction away from said one segment.

4. The mold of claim 1, wherein said wall includes an additional section which partially bounds said second portion of said casting passage, said second portion being sandwiched between said second section and said additional section of said wall, and said additional section having an additional segment with a wall thickness which is less than that at any location of said first section of said wall.

5. The mold of claim 4, wherein said casting passage has another portion and said second portion of said casting passage is located between said first portion and said other portion of said casting passage, said one dimension at said one location being smaller than at any location of said other portion, and said wall including another section which partially bounds said other portion of said casting passage, the wall thickness of said one segment being less than that at any location of said other section, and said second section and said additional section of said wall each bridging said first section and said other section of said wall.

6. The mold of claim 1, wherein said second portion of said casting passage has at least one part which narrows in a direction away from said first portion of said casting passage.

7. The mold of claim 6, wherein said second portion of said casting passage has an additional part which narrows in a direction towards said first portion of said casting passage.

8. The mold of claim 7, wherein said casting passage has another portion and said second portion of said casting passage is located between said first portion and said other portion of said casting passage, said one dimension at said one location being smaller than at any location of said other portion, and said wall including another section which partially bounds said other portion of said casting passage, the wall thickness of said one segment being less than that at any location of said other section of said wall, and said second portion of said casting passage having at least one part at which said one dimension is a minimum, said one part being substantially centered with respect to said first portion and said other portion of said casting passage.

9. The mold of claim 8, wherein said casting passage resembles a beam having a pair of flanges joined by a web.

10. The mold of claim 1, wherein said second section of said wall has at least one additional segment between said first section of said wall and said one segment of said wall, said additional segment narrowing in a direction away from said first section of said wall.

11. The mold of claim 10, wherein said second portion of said casting passage has at least one part at which said one dimension is a minimum and said one additional segment of said wall is located to one side of said one part, said second section of said wall having a second additional segment which is located to an opposite side of said one part and narrows in a direction towards said first section of said wall.

12. The mold of claim 1, wherein said first section of said wall has a substantially constant wall thickness.

13. The mold of claim 1, wherein said second section of said wall defines at least one concavity as seen from externally of said hollow member.

14. The mold of claim 1, wherein said first section of said wall has at least one location with a predetermined wall thickness less than or equal to the wall thickness at all other locations of said first section, said one segment being concave as seen from externally of said hollow member and including a first surface portion which faces said casting passage and has a first radius, and said one segment further including a second surface portion which faces away from said casting passage and has a second radius smaller than said first radius, the difference between said first radius and said second radius being less than said predetermined wall thickness.

15. A method of making a mold for the continuous casting of molten material comprising the steps of:

forming an elongated hollow member which defines at least part of a casting passage, said casting passage extending in the longitudinal direction of said hollow member and having an inlet end for the molten material and an outlet end for a continuously cast product formed from the molten material, and said casting passage including a first portion and a second portion, said second portion of said casting passage varying in at least one dimension and having at least one location where said one dimension is smaller than at any location of said first portion of said casting passage, and said hollow member comprising a wall which includes a first section partially bounding said first portion of said casting passage and a second section partially bounding said second portion of said casting passage; and reducing the wall thickness of at least one segment of said second section of said wall to a value less than that at any location section of said wall.

16. The method of claim 15, wherein the forming step comprises shaping said wall so that said second portion of said casting passage has at least one part at which said one dimension is a minimum, the reducing step being performed in such a manner that said one segment of said wall adjoins said one part.

17. The method of claim 16, wherein said second section of said wall has another segment which extends from said one segment along said one part of said casting passage, the reducing step comprising shaping said other segment such that said other segment widens in a direction away from said one segment.

18. The method of claim 15, wherein said wall includes an additional section which partially bounds said second portion of said casting passage, said second portion being sandwiched between said second section and said additional section of said wall; and further comprising the step of reducing the wall thickness of a segment of said additional section of said wall to a value less than that at any location of said first section of said wall.

19. The method of claim 15, wherein said casting passage has another portion and said second portion of said casting passage is located between said first portion and said other portion of said casting passage, said one dimension at said one location being smaller than at any location of said other portion, and said wall including another section which partially bounds said other portion of said casting passage, the reducing step including decreasing the wall thickness of said one segment of said wall to a value less than that at any location of said other section of said wall.

20. The method of claim 15, wherein the forming step comprises shaping said wall so that at least one part of said second portion of said casting passage narrows in a direction away from said first portion of said casting passage.

21. The method of claim 20, wherein the forming step comprises shaping said wall so that an additional part of said second portion of said casting passage narrows in a direction towards said first portion of said casting passage.

22. The method of claim 21, wherein said casting passage has another portion and said second portion of said casting passage is located between said first portion and said other portion of said casting passage, said one dimension at said one location being smaller than at any location of said other portion, and said wall including another section which partially bounds said other portion of said casting passage, the reducing step including decreasing the wall thickness of said one segment of said wall to a value less than that at any location of said other section of said wall, and the forming step comprising shaping said wall so that said second portion of said casting passage has at least one part at which said one dimension is a minimum, said shaping being performed in such a manner that said one part is substantially centered with respect to said first portion and said other portion of said casting passage.

23. The method of claim 22, wherein said wall is shaped in such a manner that said casting passage resembles a beam having a pair of flanges joined by a web.

24. The method of claim 15, wherein said second section of said wall has at least one additional segment between said first section of said wall and said one segment of said wall, the reducing step comprising shaping said one additional segment so that said one additional segment narrows in a direction away from said first section of said wall.

25. The method of claim 24, wherein the forming step comprises shaping said wall so that said second portion of said casting passage has at least one part at which said one dimension is a minimum, said one additional segment of said wall being located to one side of said one part, and said second section of said wall having a second additional segment which is located to an opposite side of said one part, the reducing step comprising shaping said second additional segment so that said second additional segment narrows in a direction towards said first section of said wall.

26. The method of claim 15, wherein the forming step is performed in such a manner that said first section of said wall has a substantially constant wall thickness.

27. The method of claim 15, wherein the forming step comprises shaping said second section of said wall so that said second section defines at least one concavity as seen from externally of said hollow member.

28. The method of claim 15, wherein said first section of said wall has at least one location with a predetermined wall thickness less than or equal to the wall thickness at all other locations of said first section, said one segment of said wall including a first surface portion which faces said casting passage and a second surface portion which faces away from said casting passage, and the forming step and the reducing step comprising shaping said first surface portion to produce an arc which has a first radius and is concave as seen from externally of said hollow member, the forming step and the reducing step further comprising shaping said second surface portion to produce an arc which has a second radius smaller than said first radius and is concave as seen from externally of said hollow member, and said second radius differing from said first radius by less than said predetermined wall thickness.

* * * * *